US006466679B1

(12) United States Patent
Husung

(10) Patent No.: US 6,466,679 B1
(45) Date of Patent: Oct. 15, 2002

(54) METHOD FOR REDUCING MAGNETIC NOISE FIELDS IN A HEARING AID, AND HEARING AID WITH AN INDUCTION COIL FOR IMPLEMENTING THE METHOD

(75) Inventor: Kunibert Husung, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 09/438,373

(22) Filed: Nov. 12, 1999

(30) Foreign Application Priority Data

Nov. 24, 1998 (DE) ..... 198 54 201

(51) Int. Cl.[7] ..... H04R 25/00
(52) U.S. Cl. ..... 381/324; 381/189
(58) Field of Search ..... 381/331, 189, 381/312, 322, 324; 361/816, 818; 455/280, 281

(56) References Cited

U.S. PATENT DOCUMENTS 5,287,008 A * 2/1994 Pahr ..... 307/91
5,640,457 A * 6/1997 Gnecco et al. ..... 381/312
5,809,151 A * 9/1998 Husung ..... 381/312

FOREIGN PATENT DOCUMENTS

| | | |
|---|---|---|
| DE | 8708892 | 12/1988 |
| DE | 39 17 548 | 12/1989 |
| DE | 197 12 236 | 10/1998 |

* cited by examiner

*Primary Examiner*—Sinh Tran
(74) *Attorney, Agent, or Firm*—Schiff Hardin & Waite

(57) ABSTRACT

In a hearing aid device with an induction coil and a method for reducing magnetic noise fields, a compensation-inductance is arranged in the signal line of the earphone for the active shielding of the earphone, the compensation-inductance generating a compensation field that is directed opposite the magnetic field of the induction coil. The compensation field opposes the magnetic field of the earphone and creates an active shielding of the earphone during operation of the induction coil.

9 Claims, 2 Drawing Sheets

METHOD FOR REDUCING MAGNETIC NOISE FIELDS IN A HEARING AID, AND HEARING AID WITH AN INDUCTION COIL FOR IMPLEMENTING THE METHOD

BACKGROUND OF THE INVENTION

1. Field of the Invention

The present invention is directed to a hearing aid device of the type having different assemblies for the pick-up, further processing and for the adaptation of an acoustic signal to the hearing capability of a hearing-impaired person, the hearing aid device having an earphone for the acoustic output and an induction coil for inductive pick-up of signals and a compensation-inductance for the generation of a compensation field. Further, the invention is directed to a method for reducing the magnetic noise fields that emanates from the earphone given operation of a hearing aid device with an induction coil.

2. Description of the Prior Art

A hearing aid device of the general type described above is known from German PS 197 12 236. In this known hearing aid device, the harmonic distortion of the induction coil or telephone coil or hearing coil that occurs when the induction coil is operated is reduced or avoided. The stray fields, which trigger this harmonic distortion, are generated by the printed circuit board on which the induction coil is mounted. The stray fields act proportional to the load current changes and harmonic distortions therefore result.

Low-frequency magnetic fields of the environment can be picked up by means of the induction coil or telephone coil or hearing coil of the hearing aid device, these low-frequency magnetic fields being converted into signal voltages in the hearing aid device and amplified and subjected to a signal processing before they exit the earphone as acoustic signals. These components, for example, are arranged spaced from each other in the device housing and specific shielding plates are provided in order to shield the induction coil from the earphone. These known shielding plates, however, can influence only one component of the stray field, thus an optimally complete shielding of the earphone is not possible using this structure.

In a hearing aid device, in particular, of medium performance class and high performance class and given high or maximum amplifier adjustment, it has been found that magnetic couplings occur during the operation of the induction coil, these magnetic couplings partially leading to an oscillation of the device and thereby making the hearing aid ineffective. These couplings are triggered by parasitic stray fields of the earphone and have an effect on the induction coil.

SUMMARY OF THE INVENTION

An object of the present invention is to provide a hearing aid wherein magnetic couplings during operation of the induction coil are avoided or substantially reduced by an active shielding of the earphone.

The above object is achieved in accordance with the principles of the present invention in a hearing aid having a pick-up stage for receiving an acoustic signal and converting the acoustic signal into an electrical signal, and a processing stage for processing the electrical signal and adapting it to the hearing disability of a hearing-impaired person, and an earphone to which the processed electrical signal is supplied for conversion into an output acoustic signal, and having an induction coil for inductively picking-up acoustic signals, and a method for operating such a hearing aid device, wherein a compensation inductance is provided for generating a compensation field, and wherein the compensation inductance is connected in the signal line between the processing stage and the earphone and wherein, during operation of the induction coil, the compensation inductance generates a compensation field which is directed toward the magnetic field produced by the induction coil and which opposes the magnetic field produced by the earphone, so as to actively shield the earphone and prevent the magnetic field produced by the earphone from influencing the induction coil, thereby producing unwanted noise signals in the inductively-generated current produced by the induction coil.

A fundamental wave compensation ensues in the invention; the signal amplitudes are influenced by the inductance and not the harmonics. Inventively, the compensation-inductance is an SMD coil permeated by the earphone current for achieving an active shielding of the earphone. The problem of magnetic couplings in the induction coil operation is simply solved by the utilization of an SMD coil. This inductance is switched into the earphone line, so the coil has the earphone current flowing therein, and the emitted compensation field corresponds to the parasitic stray field of the earphone. The compensation-inductance is directed toward the induction coil and the compensation field acts opposite to the earphone field at the same time, so that a negative feedback results, which leads to a suppression of the coupling. The strength of the negative feedback can be adjusted by the number of turns of the coil and/or by the arrangement of the compensation coil in the area of the induction coil. A specific advantage of the SMD coil is the ability to position it by machine equipping, so that the position of the SMD coil is always exactly definable during the manufacture of the hearing aid device. Furthermore, the manufacturing costs can be reduced, since shielding plates are no longer required. Moreover, the inventive hearing aid device can be constructed smaller, since the shielding plates are foregone and the earphone and the induction coil are arranged at a smaller distance from each other. Also, stray field tolerances of the earphone can be compensated by redimensioning the SMD coil.

DESCRIPTION OF THE PREFERRED EMBODIMENTS

Figure 1:
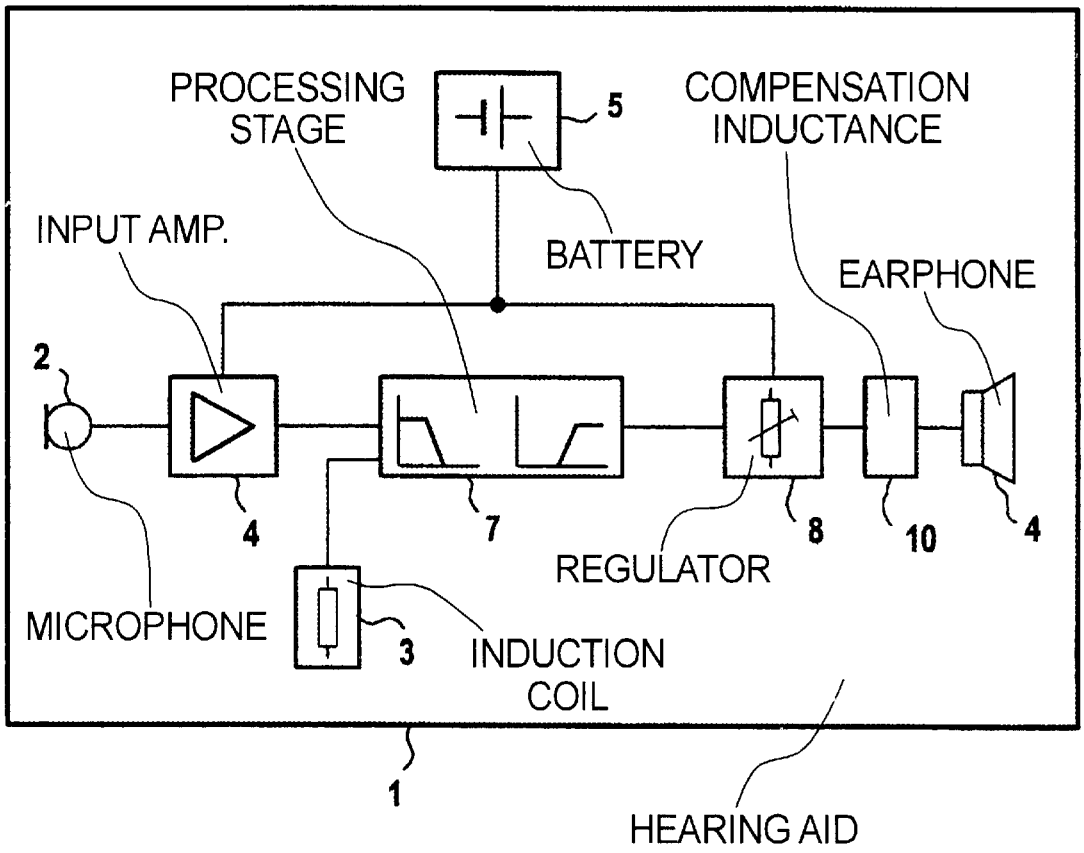
FIG. 1 is a simplified, schematic illustration of the basic assemblies of the inventive hearing aid device.

The hearing aid 1, which is shown in a simplified fashion in the form of an block circuit diagram, has at least one microphone 2 for converting an acoustic signal into an electrical signal. Further, an induction coil 3 is provided which allows the person wearing the hearing aid 1 to receive the signals of a conversation partner by induction, without transmission of an acoustic field such as for telephone conversations. Further, this allows the hearing-impaired person to receive without unwanted noises and reverberations, signals from closely-located microphones or speakers, for example, in churches or theaters.

The signals of the microphone 2 or of the induction coil 3 are amplified in an input amplifier 4, and are supplied to a processing stage 7 having at least a low-pass filter and a high-pass filter, and are subsequently supplied to the earphone 9 via a regulator or a volume control 8. The processing stage 7 adapts the incoming signal to the hearing disability of the hearing-impaired person using the hearing aid. The hearing aid 1 is operated by a battery 5.

Figure 2:
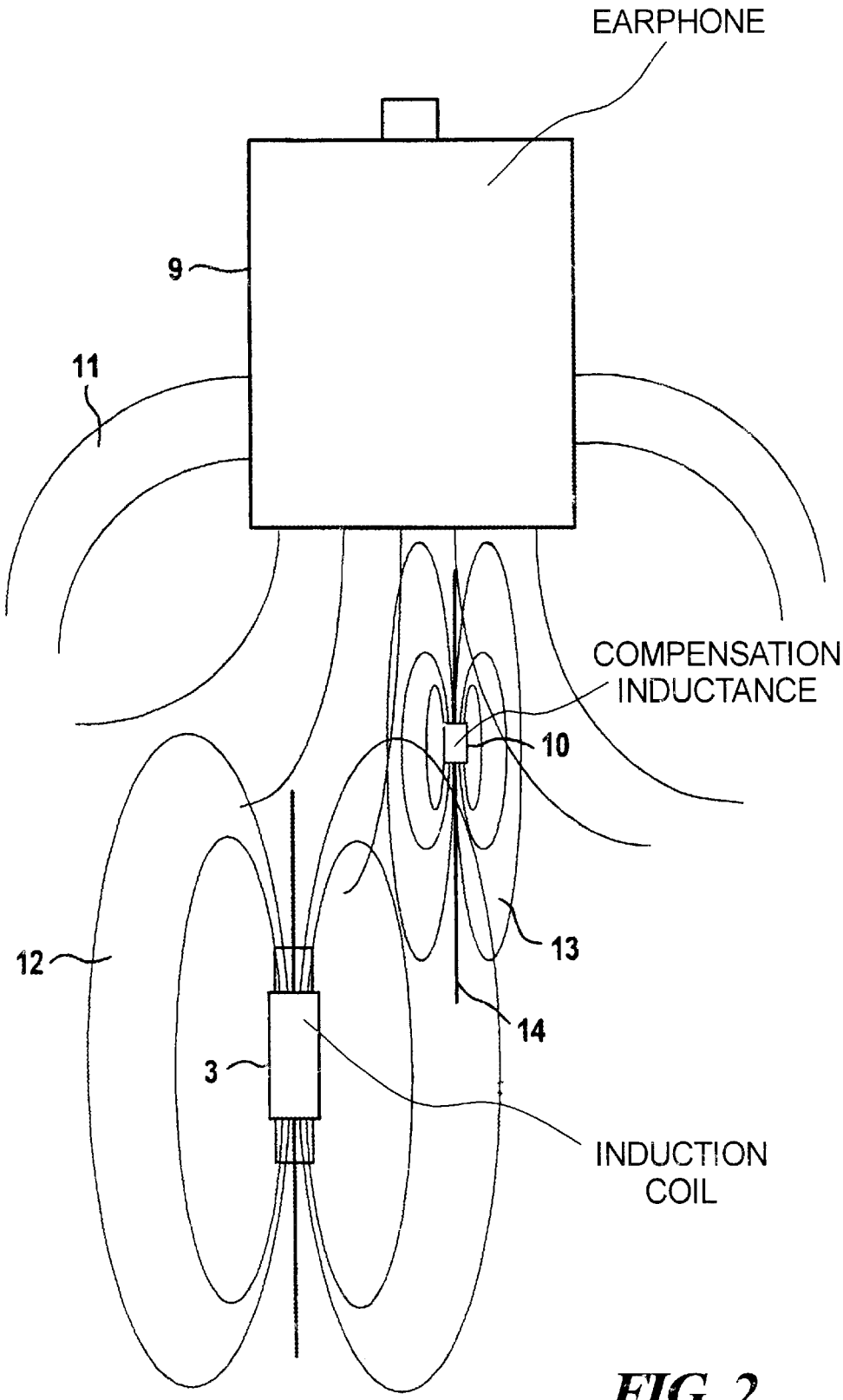
FIG. 2 shows the magnetic fields of the SMD compensation coil relative to the induction coil and relative to the earphone.

According to the invention, a compensation-inductance 10 is arranged in the signal line of the earphone 9 for the active shielding of the earphone 9. Advantageously, a SMD compensation coil that is arranged in immediate proximity to the induction coil 3 (or telephone coil 3 or hearing coil 3) is provided as the compensation-inductance 10. As it can be seen from FIG. 2, the SMD coil 10 that is fed by the compensation current 14, which corresponds to the supply current of the earphone 9, generates a compensation field 13 that, during operation of the induction coil 3, shields its magnetic field 12 from the magnetic field 11 of the earphone 9. In a preferred embodiment, an effective active shielding of the earphone is achieved with an SMD coil having an inductance of approximately 15 nH. Thus, the number of turns of the SMD coil can be limited to approximately 3 through 5 turns.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid comprising:

an input transducer which receives incoming acoustic signals and converts said incoming acoustic signals into electrical signals;

a processing stage connected to said input transducer and supplied with said electrical signals for processing said electrical signals and adapting said electrical signals to a hearing disability of a hearing-impaired person, for producing processed signals at an output of the processing stage;

an earphone connected via a signal line to said output of said processing stage which converts said processed signals into output acoustical signals, said earphone having a magnetic field associated therewith;

a selectively operable induction coil connected to said processing stage, for inductively receiving signals and for converting the inductively received signals into a current supplied to said processing stage for inclusion in said processed signals; and a compensation inductance connected in said signal line between said output of said processing stage and said earphone, said compensation inductance generating a compensation magnetic field opposite to the magnetic field generated by said earphone, for actively shielding said earphone from said induction coil to prevent said magnetic field generated by said earphone from being inductively coupled to said induction coil.

2. A hearing aid as claimed in claim 1 wherein said compensation inductance comprises an SMD compensation coil having a plurality of coil turns selected to produce a strength of said compensation magnetic field for the active shielding.

3. A hearing aid as claimed in claim 1 wherein said compensation inductance comprises an SMD compensation coil, and wherein said SMD compensation coil is disposed at a location between said induction coil and said earphone to produce said compensation magnetic field at a strength sufficient for actively shielding said earphone.

4. A hearing aid as claimed in claim 1 wherein said compensation inductance comprises an SMD compensation coil, said compensation coil having a selected number of coil turns, and being disposed at a location between said induction coil and said earphone for, in combination, producing said compensation magnetic field at a strength effective for actively shielding said earphone.

5. A hearing aid as claimed in claim 1 wherein said magnetic field produced by said earphone comprises a magnetic stray field, and wherein said compensation inductance generates said compensation magnetic field in a region surrounding said induction coil at a strength approximately equaling said magnetic stray field of said earphone.

6. A hearing aid as claimed in claim 5 wherein said compensation inductance is selectively dimensionable to accommodate tolerances of said magnetic stray field of said earphone.

7. A hearing aid as claimed in claim 1 wherein said compensation inductance has a magnitude of approximately 15 nH.

8. A method for operating a hearing aid comprising the steps of:

selectively operating an induction coil to inductively receive signals and to produce an electrical signal corresponding to the inductively received signals;

processing said electrical signal to adapt said electrical signal to a hearing disability of a hearing-impaired person, to produce a processed signal;

supplying said processed signal via a signal line to an earphone to produce an output acoustical signal, said earphone having a magnetic field associated therewith; and connecting a compensation inductance in said signal line and, using said compensation inductance, generating a compensation magnetic field opposing said magnetic field associated with said earphone to actively shield said earphone and prevent coupling of said magnetic field associated with said earphone with said induction coil.

9. A method as claimed in claim 8 wherein said magnetic field associated with said earphone produces a fundamental wave in said electrical signal and wherein said compensation magnetic field prevents generation of said fundamental wave in said electrical signal.

* * * * *